United States Patent [19]

Verweij et al.

[11] Patent Number: 5,060,406

[45] Date of Patent: Oct. 29, 1991

[54] STEAM IRON HAVING A HYDROPHILIC ACID RESISTANT STEAM CHANGER

[75] Inventors: Hendrik Verweij; Paulus H. G. Offermans, both of Eindhoven; Andreas P. L. Krebbers; Arend Schuurman, both of Drachten, all of Netherlands

[73] Assignee: U.S. Philips Corporation, New York, N.Y.

[21] Appl. No.: 591,903

[22] Filed: Oct. 2, 1990

[30] Foreign Application Priority Data

Oct. 25, 1989 [NL] Netherlands ..... 8902638

[51] Int. Cl.[5] ..... D06F 75/18; C23C 22/07

[52] U.S. Cl. ..... 38/77.83; 148/256

[58] Field of Search ..... 38/16, 74, 77.5, 77.7, 38/77.8, 77.83, 85, 88, 89; 427/318; 501/16; 148/256, 262

[56] References Cited

U.S. PATENT DOCUMENTS

| | | | |
|---|---|---|---|
| 2,120,212 | 6/1938 | Curtin | 148/256 X |
| 2,413,949 | 1/1947 | Broverman | 148/256 X |
| 2,683,320 | 7/1954 | Morton | 38/77.83 |
| 2,845,376 | 7/1958 | Hyams | 148/256 |
| 2,967,365 | 1/1961 | Extale et al. | 38/77.83 |
| 3,101,561 | 8/1963 | Albrecht et al. | 38/77.83 X |
| 3,499,234 | 3/1970 | Piper | 38/77.83 |
| 3,551,183 | 12/1970 | Vondrack et al. | 427/318 |
| 3,565,699 | 2/1971 | Plaxton | 148/256 X |
| 3,642,541 | 2/1972 | Shepard | 148/262 X |
| 3,694,942 | 10/1972 | Vondracek et al. | 38/77.83 |
| 3,989,550 | 11/1976 | Newhard | 148/256 |
| 4,462,842 | 7/1984 | Uchiyama et al. | 148/256 X |

*Primary Examiner*—Werner H. Schroeder
*Assistant Examiner*—Ismael Izaguirre
*Attorney, Agent, or Firm*—Norman N. Spain

[57] ABSTRACT

A steam iron having an acid-resistant, hydrophilic coating in the steam chamber. The steam chamber coating is provided from an acid, colloidal suspension comprising alumina, magnesia, silica, or mixtures thereof, and contains, preferably, an acid phosphate compound. In this case, particularly $Al(H_2PO_4)_3$ is very suitable. The steam chamber coating is very corrosion-resistant.

6 Claims, 2 Drawing Sheets

STEAM IRON HAVING A HYDROPHILIC ACID RESISTANT STEAM CHANGER

BACKGROUND OF THE INVENTION

The invention relates to a steam iron comprising a steam chamber which is provided with a hydrophilic coating. The invention further relates to a method of providing a hydrophilic coating in the steam chamber of a steam iron.

Present day steam irons comprise a water reservoir from which water is fed at an adjustable and regular rate to the steam chamber. Said steam chamber is partly located in the part of the steam iron to be heated, namely the soleplate of the iron. In the steam chamber the water is converted into steam after which said steam is fed outwards through steam ports in the soleplate of the iron.

In general, the steam chamber is bounded by metal walls which are generally composed of aluminum. When water is fed from the reservoir directly onto the hot metal bottom of the steam chamber the so-called "Leiden-frost" effect occurs: the water is not optimally distributed over the bottom surface and remains bouncing about on the surface in the form of large drops; it is even possible for these drops to fly off the surface, pass through the steam chamber and leave the iron through the steam ports. In such a situation, the formation of steam is not optimal. In order to preclude this undesirable effect a hydrophilic and moderate heat-insulating coating is customarily applied to at least the bottom of the steam chamber. By virtue of the hydrophilic character of the steam chamber coating the water introduced spreads readily over the bottom of the steam chamber. The moderate heat-insulating character of the layer ensures a gradual heat transfer from the soleplate of the iron to the water that is introduced. Both properties of the steam chamber coating contribute to the water being regularly and efficiently converted into steam.

A steam iron of the type described in the opening paragraph is known from, inter alia, British Patent Specification GB 773,741. The steam chamber coating used in this patent specification is mainly composed of silica and fillers which are provided on the bottom of the steam chamber from an alkaline colloidal suspension, preferably, by means of a spraying process. According to this patent specification, a steam chamber coating having optimum properties is obtained when the colloidal suspension is stabilised with NaOH in the range from pH 9.5–10.5.

Applicants have ascertained that the known steam iron has disadvantages. For example, it has been found that corrosion problems occur, in particular, in an environment having a high degree of humidity and a relatively high temperature. This causes flakes to break away from the steam chamber coating which can leave the iron through the steam ports. This situation is found to be very disadvantageous.

SUMMARY OF THE INVENTION

One of the objects of the invention is to overcome the above-mentioned corrosion problem. For this purpose, it is an object of the invention to provide, in particular, a steam iron which is provided with a steam chamber coating which is not sensitive to corrosion in a warm and humid environment. A further object is to provide an inventive method of providing such a corrosion resistant coating in the steam chamber of a steam iron.

These and other objects are achieved by, a steam iron of the type described in the opening paragraph, which is characterized according to the invention in that the hydrophilic steam chamber coating is acid-resistant.

DESCRIPTION OF THE PREFERRED EMBODIMENTS

Figure 1:
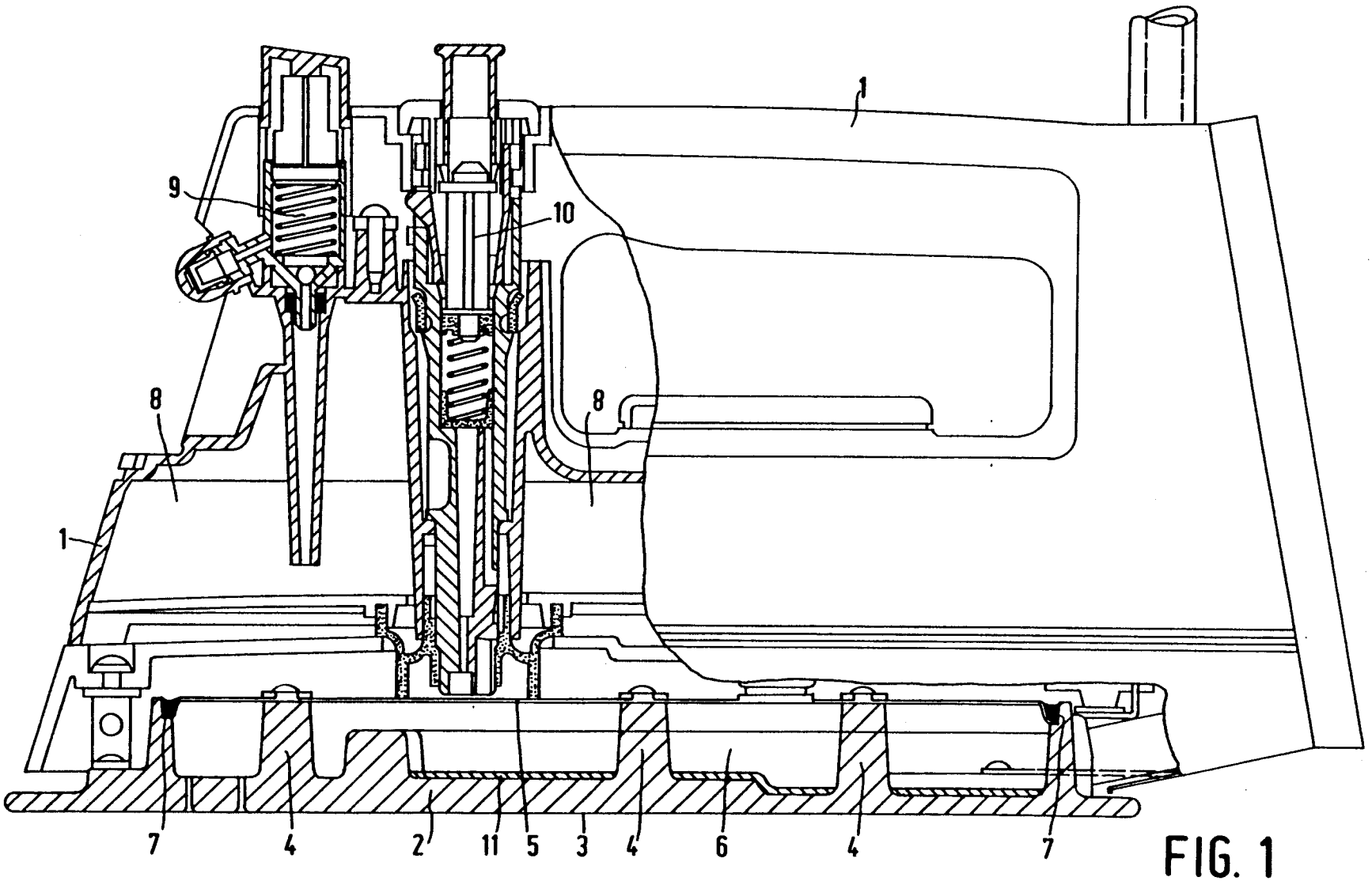
FIG. 1 is a view partly in cross-section and partly in elevation of a steam iron according to the invention.

In experiments leading to the invention it has been found that the corrosion problem of the known steam chamber coating is caused by a reaction of the alkaline stabilizer, for example the NaOH present in the silica layer, with the material of the soleplate of the iron, which is generally composed of aluminum. So far the exact mechanism is not clear.

It has further been found that the known steam chamber coating is sensitive to acid attack. This acid may originate from the seals used for the steam chamber, which are customarily composed of an elastic silicone rubber in which a small quantity of acetic acid is present. This acid may escape from the seal, in particular in a warm environment, and subsequently bring about corrosion. It has also been found that prolonged use of a diluted acetic acid solution as a decalcifier will considerably increase the corrosion problem. On the basis of the above experimental results Applicants have gained the insight that the presence of an acid-resistant steam chamber layer is of essential importance to overcome the above mentioned corrosion problems.

According to a preferred embodiment of the invention, the hydrophilic steam chamber coating comprises an acid phosphate compound. This is to be understood to mean a metal-phosphate compound in which the phosphate is at least singly protonated ($HPO_4^{2-}$ or $H_2PO_4^-$). Examples of such compounds are $MgHPO_4$ and $Zn(H_2PO_4)_2$. It has been found that the presence of such an acid phosphate compound in the steam chamber coating obviates the corrosion problem to a large degree. As will be explained hereinafter, such an acid phosphate compound can be used as the stabiliser of an acid colloidal silica-suspension.

It has been demonstrated that in this respect aluminum phosphate compounds, more particularly aluminum triphosphate ($Al(H_2PO_4)_3$) can be employed very advantageously. These compounds which are used as acid stabilisers of a colloidal silica suspension are thickened from the suspension, partly along with the silica, in the steam chamber coating in which they then serve as binders. It has been found that the presence of aluminum phosphate in the steam chamber coating ensures that such a coating is particularly insoluble in water and also very acid resistant.

The invention also relates to a method of providing a hydrophilic coating in the steam chamber of a steam iron. This method is characterized in that a colloidal suspension comprising alumina, silica or magnesia, or mixtures thereof, is acidified to pH 1–3 by means of an acid stabiliser, after which the suspension is introduced into the steam chamber and is thickened into an acid-resistant, hydrophilic steam chamber coating. The suspension may alternatively comprise further fillers. A preferred embodiment of the method according to the invention is characterized in that an aluminum phosphate, in particular $Al(H_2PO_4)_3$, is used as the acid stabiliser.

The invention will be explained in greater detail by means of exemplary embodiments and with reference to the accompanying drawings.

It is to be noted, that for clarity the absolute and relative dimensions of the various components are not drawn to scale, in every detail. In the Figures, identical parts bear the same reference numerals.

The steam iron shown in FIG. 1 is composed of a housing 1 which is closed on the bottom side by an aluminum soleplate 2 which is provided with a thin layer of stainless steel on the underside 3. The soleplate is provided with upright ribs 4 on the inside, on which ribs an aluminum plate 5 is provided in such a manner that a steam chamber 6 is formed between the inside of the soleplate 2 and the plate 5. The steam chamber 6 is sealed by an elastic silicone rubber 7. The steam iron further comprises a water reservoir 8. By means of a pumping mechanism 9, water from the reservoir 8 can be sprayed directly onto the clothes to be ironed. By means of a pumping mechanism 10, water can be pumped from the reservoir 8 into the steam chamber 5, thus increasing the steam output. This water passes through an aperture in plate 5 onto the bottom of the steam chamber 6. In GB-A 2,213,207, a more detailed description is given of the pumping mechanism 9 and 10. The bottom of the steam chamber 6 is provided with an hydrophilic steam chamber coating 11.

Figure 2:
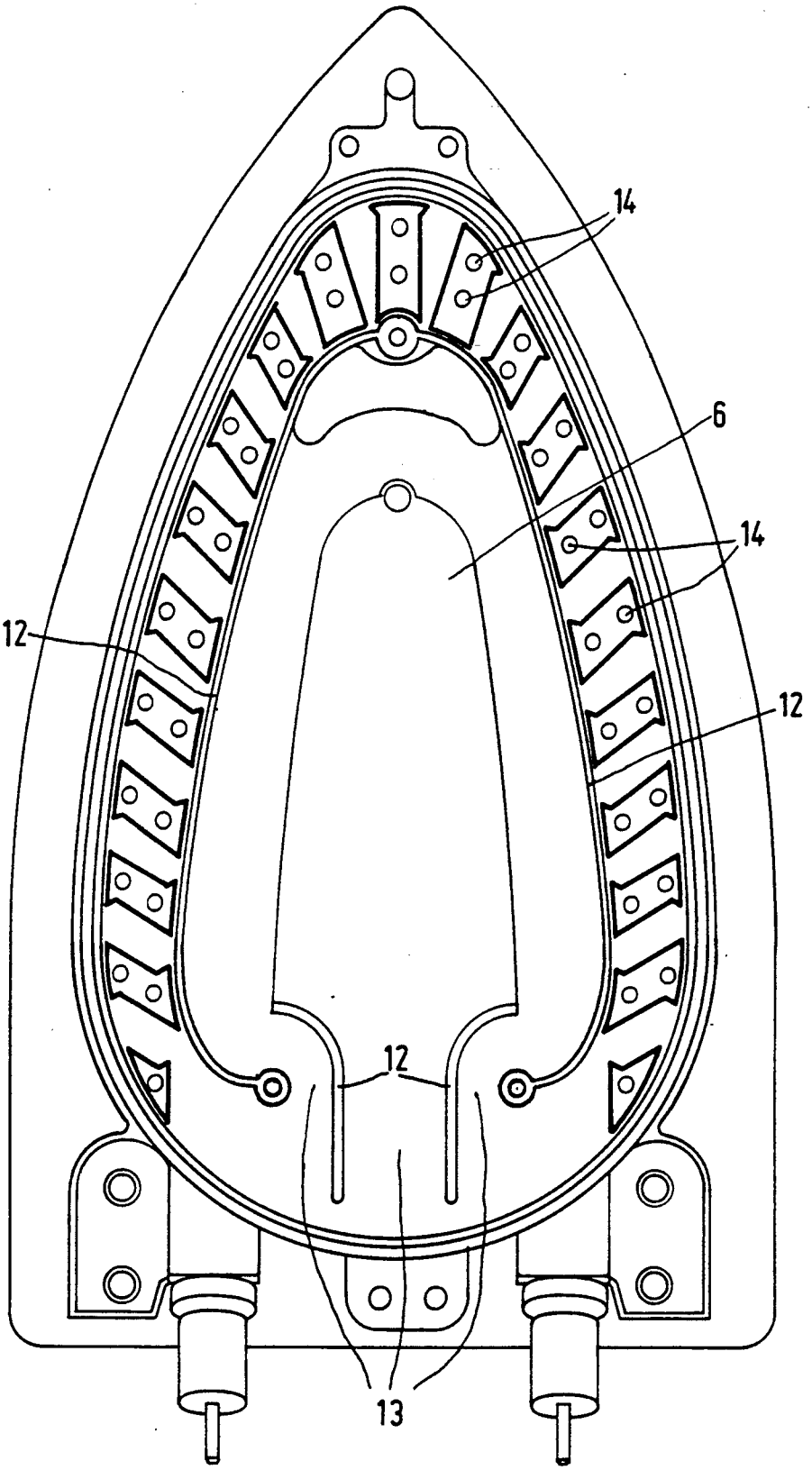
FIG. 2 is a top view of a soleplate of the steam iron according to the invention.

FIG. 2 is a top view of the separate soleplate 2. The steam chamber 6 is bounded by a wall 12. The steam formed can leave the steam chamber through apertures 13 and, subsequently, it can leave the iron through apertures 14 in the soleplate 2, the so-called steam ports. The bottom of the steam chamber 6 and a portion of the wall 12 is covered with a hydrophilic coating.

The hydrophilic coating is manufactured and provided as described hereinbelow. An aqueous suspension of colloidal $SiO_2$ and a filler such as mullite ($3Al_2O_3$.-$SiO_2$ ) are stabilised to a pH of 2.0 using $\pm 10\%$ by weight of $Al(H_2PO_4)_3$. The suspension is subsequently applied to the bottom of the steam chamber 6 and then thickened. In this manner a hydrophilic steam chamber coating 11 (FIG. 1) is obtained. The mutual bond of the suspension particles and the adherence to the aluminum bottom of the steam chamber are enhanced because the acid $H_2PO_4^{2-}$ ions react both with metals and oxides until stable, insoluble compounds are formed which no longer react with water. It has been found that colloidal suspensions comprising alumina, silica, magnesia, or mixtures thereof, yeild an acid-resistant steam chamber coating when they are applied by means of the method according to the invention.

Further, it has been ascertained that, in order to produce a favorable effect, the quantity of acid phosphate in the steam chamber coating must amount to 1–40% by weight. Preferably, the quantity of acid phosphate is 10% by weight.

In an accelerated life test a number of steam irons according to the invention and a number of conventional irons were compared. The hydrophilic steam chamber coating of the conventional irons was composed of a silicate layer which was provided from an alkaline colloidal suspension as described in GB 773,741. The irons according to the invention were provided with an aluminum silicate layer which was provided from an acid colloidal suspension. The acidity of the latter colloidal solution was adjusted to pH 2.0 by means of $\pm 10\%$ by weight of $Al(H_2PO_4)_3$. Both types of steam irons were placed in a climatic chamber for 14 days at a temperature of 30° C. and a relative humidity of 95. The known steam chamber coating exhibited a strong degree of flaking after the test whereas the steam chamber coating according to the invention was unaffected.

We claim:

1. A steam iron comprising a steam chamber provided with a hydrophilic acid resistant coating comprising an acid phosphate compound.

2. A steam iron comprising a steam chamber provided with a hydrophilic coating, said coating being acid resistant and comprising an aluminum phosphate compound.

3. A steam iron as claimed in claim 2 wherein the aluminum phosphate compound is $Al(H_2PO_4)_3$.

4. A steam iron comprising a steam chamber provided with a hydrophilic acid resistant coating, said coating having a pH of 1–3 and comprising an acid phosphate compound.

5. A method of providing an acid resistant hydrophilic coating in the steam chamber of a steam iron, said method comprising preparing a colloidal suspension comprising an oxide selected from the group consisting of alumina, silica and magnesia and mixtures of said oxides acidifying said suspension to a pH value of 1–3 by acid stabilizer means, introducing said suspension into the steam chamber and thickening said suspension to form an acid-resistant, hydrophilic coating.

6. A method as claimed in claim 5, wherein aluminum phosphate is used as the acid stabiliser.

* * * * *